US011925845B2

(12) United States Patent
Escobar

(10) Patent No.: US 11,925,845 B2
(45) Date of Patent: Mar. 12, 2024

(54) GOAL FOR FOOT GOLF

(71) Applicant: Edgar Escobar, Powell, OH (US)

(72) Inventor: Edgar Escobar, Powell, OH (US)

( * ) Notice: Subject to any disclaimer, the term of this patent is extended or adjusted under 35 U.S.C. 154(b) by 0 days.

(21) Appl. No.: 17/492,821

(22) Filed: Oct. 4, 2021

(65) Prior Publication Data

US 2022/0105401 A1 Apr. 7, 2022

Related U.S. Application Data

(60) Provisional application No. 63/086,623, filed on Oct. 2, 2020.

(51) Int. Cl.

| | |
|---|---|
| ***A63B 67/02*** | (2006.01) |
| ***A63B 63/00*** | (2006.01) |
| ***A63B 71/02*** | (2006.01) |

(52) U.S. Cl.

CPC ..... *A63B 67/02* (2013.01); *A63B 63/007* (2013.01); *A63B 71/023* (2013.01); *A63B 2071/024* (2013.01)

(58) Field of Classification Search

CPC ..... A63B 57/40; A63B 57/357; A63B 63/007; A63B 67/02; A63B 69/3676; A63B 71/023; A46B 3/00–22

See application file for complete search history.

(56) References Cited

U.S. PATENT DOCUMENTS

| | | | | |
|---|---|---|---|---|
| 1,208,838 A | | 12/1916 | Rolfe | |
| 2,467,549 A | * | 4/1949 | Ely | A63B 57/357 273/127 R |
| 2,882,544 A | * | 4/1959 | Hadidian | A46B 7/06 401/268 |
| 3,338,579 A | | 8/1967 | McKain | |
| 3,507,499 A | | 4/1970 | Rice | |
| 4,359,225 A | * | 11/1982 | Baldorossi | A63B 71/04 473/187 |
| 4,809,988 A | * | 3/1989 | Hunter | A63B 71/04 273/408 |
| 10,478,701 B2 | * | 11/2019 | Rimback | A63B 69/3697 |

FOREIGN PATENT DOCUMENTS

| | | | | |
|---|---|---|---|---|
| DE | 10246952 B4 | * | 7/2004 | A63B 63/007 |
| GB | 2257637 A | * | 1/1993 | A63B 57/357 |

OTHER PUBLICATIONS

English machine translation of Dietrich (DE 10246952 B4) (Year: 2004).*

MultiGolf, https://www.discgolfpark.com/multigolf/, archived by the Internet Archive on Jun. 16, 2020 (Year: 2020).*

* cited by examiner

*Primary Examiner* — Laura Davison

(74) *Attorney, Agent, or Firm* — Standley Law Group LLP; Kenny W. Pung; Jeffrey C. Norris

(57) ABSTRACT

A goal for foot golf. The goal includes a suspension platform that is configured for suspension above the ground and a plurality of fingers that extend downwards from the suspension platform. The suspension platform can be hung from a structure or supported from below by a stand. The plurality of fingers includes a plurality of outer fingers that are disposed about the suspension platform in a circular arrangement that substantially matches the size and shape of a regulation foot golf hole.

11 Claims, 13 Drawing Sheets

GOAL FOR FOOT GOLF

CROSS-REFERENCE TO RELATED APPLICATIONS

This application is a nonprovisional patent application that makes a priority claim to U.S. Provisional Application No. 63/086,623.

FIELD

The application relates to goals for foot golf and, more particularly, to attachable goals for foot golf that can simulate the making of a foot golf goal without having to dig a hole in the ground.

BACKGROUND

Foot golf is a sport in which players kick a soccer ball into a hole (i.e., goal) in as few shots as possible. While it is rapidly increasing in popularity, featuring worldwide play and organized tournaments, many would-be players are unable to play the sport due to a lack of foot golf courses. Like with conventional golf courses, foot golf courses require a sizable area of land, well-kept grounds, a series of defined play areas, and a hole (i.e., goal) for each play area. Due to these requirements, it is often impracticable or otherwise not feasible to construct a footgolf course, especially considering footgolf's relatively small (but growing) player base.

One possible option for increasing the available number of foot golf courses is to adapt disc golf courses. Disc golf courses would normally meet the requirements for a foot golf course except that the goals used for disc golf impede the ability to place a hole.

Another issue with foot golf is the fact that foot golf holes are rather sizeable. According to Foot Golf Federation Rule 3-2-10, a regulation hole must be 50-52 centimeters in diameter and at least 28 centimeters in depth. It is generally contemplated that many would-be foot golf players are deterred from playing foot golf due to an unwillingness or an inability to create and maintain a hole of this size in the ground.

Accordingly, those skilled in the art continue with research and development efforts in the field of foot golf goals.

SUMMARY OF THE INVENTION

Disclosed are goals for foot golf that include a suspension platform and a plurality of fingers.

In one embodiment, the suspension platform is configured for suspension above the ground. The suspension platform includes a body that is configured to support a plurality of fingers. The plurality of fingers includes a plurality of outer fingers. The plurality of outer fingers extends downwards from the suspension platform. The plurality of outer fingers is disposed about the suspension platform in a circular arrangement having a diameter substantially equal to that of a regulation foot golf hole.

In another embodiment, the suspension platform is configured to hang from a structure. The suspension platform includes a body that is configured to support a plurality of fingers. The plurality of fingers includes a plurality of outer fingers. The plurality of outer fingers extends downwards from the suspension platform. The plurality of outer fingers is disposed about the suspension platform in a circular arrangement having a diameter substantially equal to that of a regulation foot golf hole. The goal further includes a plurality of attachment members connected to the body of the suspension platform. The plurality of attachment members is configured to enable attachment of the suspension platform to a structure.

In yet another embodiment, the suspension platform is configured for suspension above the ground. The suspension platform includes a body that is configured to support a plurality of fingers. The plurality of fingers includes a plurality of outer fingers. The plurality of outer fingers extends downwards from the suspension platform. The plurality of outer fingers is disposed about the suspension platform in a circular arrangement having a diameter substantially equal to that of a regulation foot golf hole. The goal further includes a stand that is positionable underneath the suspension platform. The stand is configured to support the suspension platform from below.

Other example of the disclosed goal for foot golf will become apparent from the following detailed description, the accompany drawings, and the appended claims.

DETAILED DESCRIPTION

Figure 1:
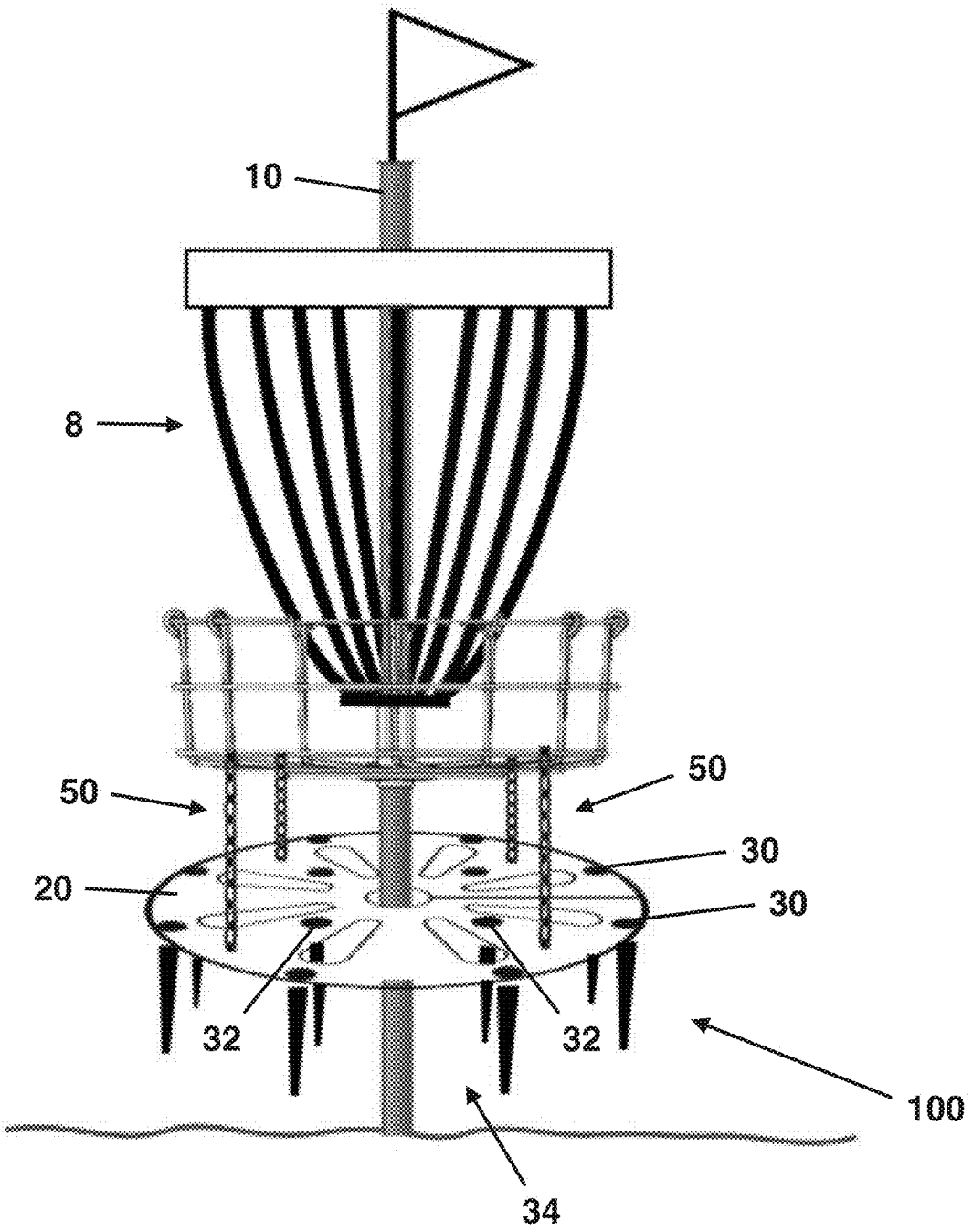
FIG. 1 is a perspective view of a disc golf goal with a first embodiment of the goal for foot golf attached.

The following detailed description refers to the accompanying drawings, which illustrate specific examples described by the disclosure. Other examples having different structures and operations do not depart from the scope of the present disclosure. Like reference numerals may refer to the same feature, element, or component in the different drawings.

Illustrative, non-exhaustive examples, which may be, but are not necessarily, claimed, of the subject matter according the present disclosure are provided below. Reference herein to "example" means that one or more feature, structure, element, component, characteristic and/or operational step described in connection with the example is included in at least one embodiment and/or implementation of the subject matter according to the present disclosure. Thus, the phrase "an example" and similar language throughout the present disclosure may, but do not necessarily, refer to the same example. Further, the subject matter characterizing any one example may, but does not necessarily, include the subject matter characterizing any other example.

The present disclosure relates to a goal for foot golf (herein, the "goal"). Several embodiments of the goal are provided herein. The goal includes a suspension platform that is configured for suspension above the ground and a plurality of fingers extending downwards from the suspension platform. Due to the arrangement of the fingers, the goal is capable of capturing balls that are kicked, pushed, or otherwise moved towards the goal, thereby simulating the making of a foot golf goal without having to dig a hole in the ground.

Referring to FIG. 1, the present disclosure provides a first exemplary embodiment of the goal 100. This goal 100 includes a suspension platform 20, a plurality of fingers 30, 32 and a plurality of attachment members 50. The plurality of fingers 30 is supported by and extends downwards from the suspension platform 20, whereas the attachment members 50 are used to attach the suspension platform 20 to a structure 10.

Figure 2:
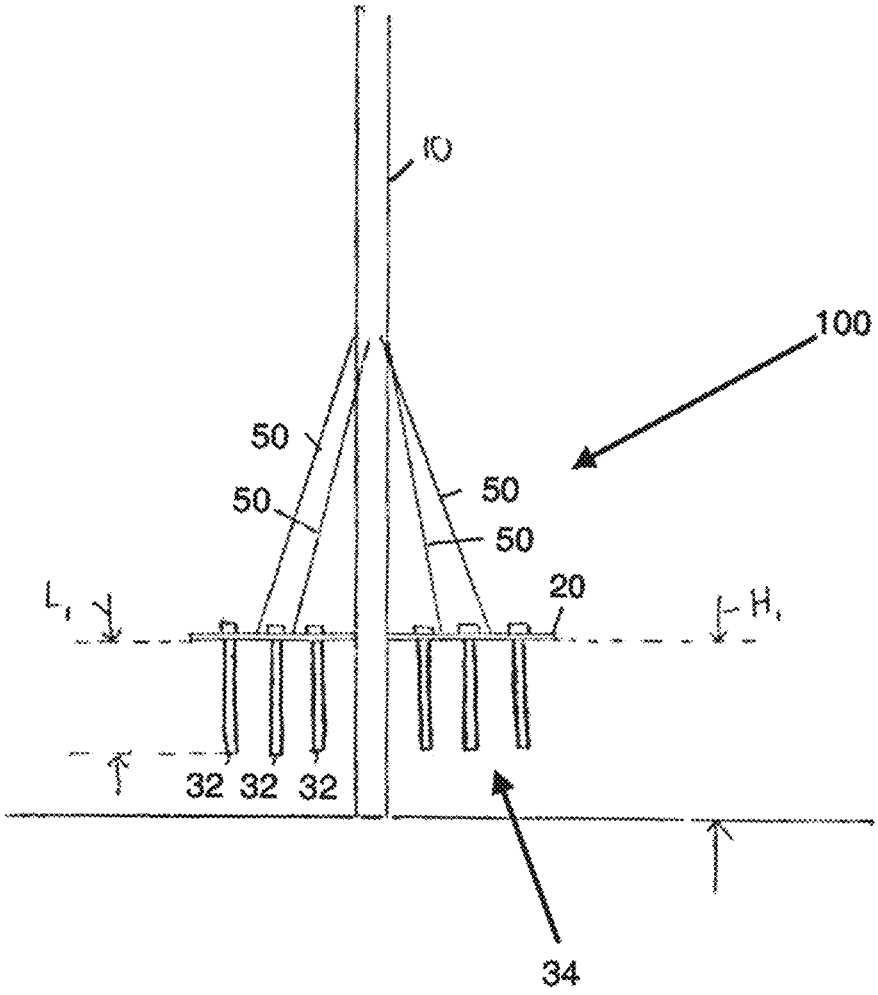
FIG. 2 is a front view of the first embodiment of the goal attached to a linear structure.
Figure 3:
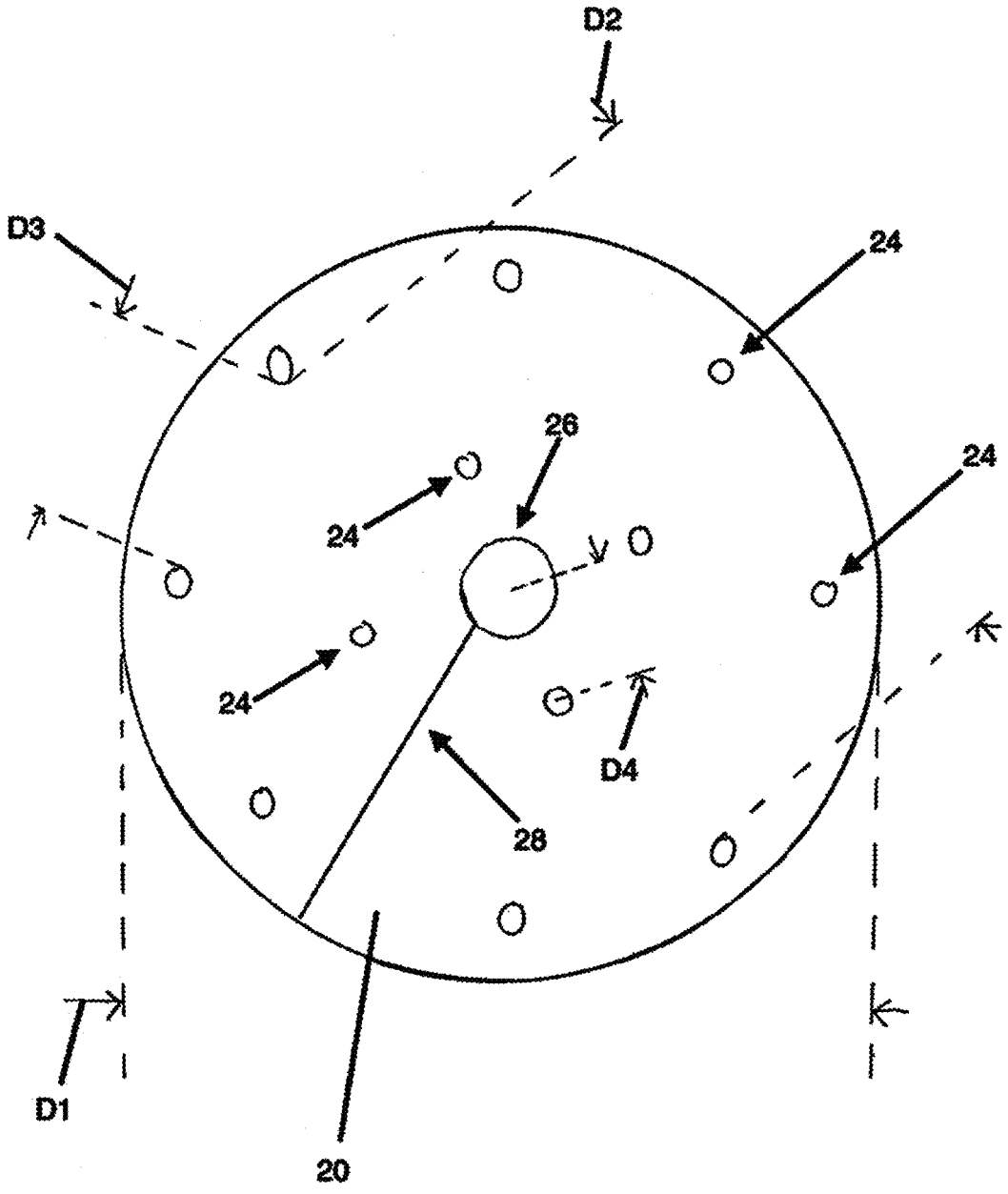
FIG. 3 is a top plan view of a suspension platform.

Referring to FIGS. 2 and 3, the suspension platform 20 includes a body that is generally planar and circular in shape. This design is preferred because the planarity provides for easy storage and transportation, and the circular shape corresponds with the circular shape of a foot golf hole. In a preferred embodiment, this suspension platform 20 may have a diameter $D_1$ ranging from about 18 inches to about 22 inches. Other embodiments may vary have having polygonal or irregularly shaped suspension platforms, or non-planar suspension platforms, or suspension platforms of different sizes. Variations such as these will not result in a departure from the scope of the present disclosure.

Figure 10:
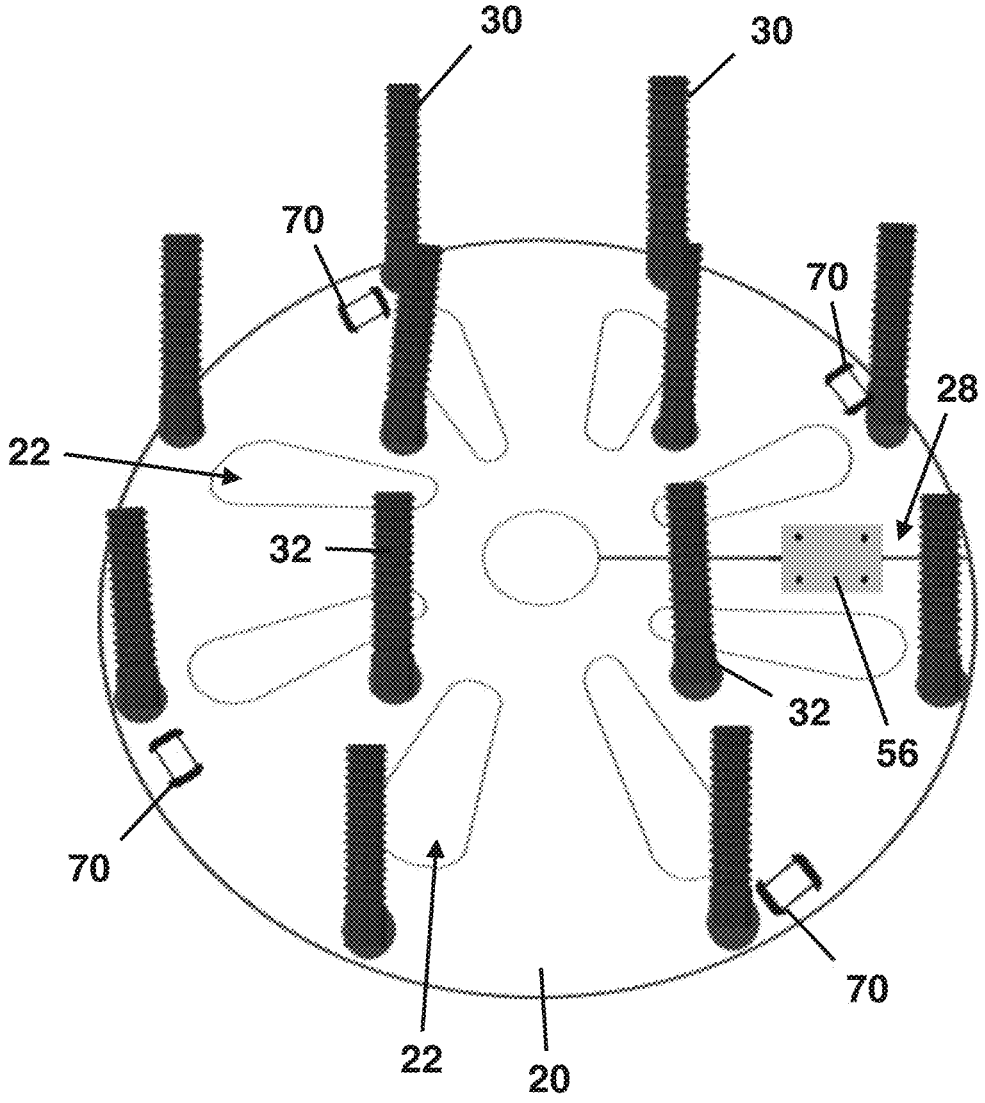
FIG. 10 is a bottom plan view of the goal of FIG. 8.

In preferred embodiments, the suspension platform 20 may include a plurality of cut-outs 22 (i.e., openings) in the body of the suspension platform 20 (best shown in FIG. 10). These cut-outs 22 need not be limited to any particular size, shape, and/or quantity. Given that the goal is likely to be utilized in outdoor environments, it is contemplated that these cut-outs 22 may provide a way for rain, snow, and/or other types of precipitation to pass through the suspension platform 20 instead of accumulating on top of it. These cut-outs 22 may also reduce the overall weight of the goal 100.

In the embodiment shown, the goal 100 includes outer fingers 30 and inner fingers 32. The outer fingers 32 defines a capture space 34 corresponding to the outer boundaries of a foot golf goal. Balls that are moved towards the capture space 34 may enter the capture space 34 by traveling between the outer fingers 30 or by impacting the outer fingers 30 and bending them around the ball. The outer fingers 30 may then retain the balls within the capture space 34 to prevent the balls from escaping. In this way, the goal 100 may simulate the making of a foot golf goal. Alternatively, if the ball is not moved towards the goal 100 with enough velocity to enter the capture space 34, the outer fingers 30 may also stop the movement of the ball by pinning the ball against the ground or by catching them between two outer fingers 30. Doing so simulates instances where a ball enters a foot golf hole at low speeds.

The arrangement of outer fingers 30 along the suspension platform 20 (i.e., the points from which they extend) defines the shape of the capture space 34. While it is contemplated that various outer finger 30 arrangements may be utilized, it is contemplated that a circular arrangement is preferred because regulation foot golf holes are circular in shape. Further, given that foot golf holes are about 19 inches to about 21 inches in diameter, it is contemplated that a circular outer finger 30 arrangement that defines a circular capture space 34 (i.e., in horizontal cross-section) that is about 19 inches to about 21 inches in diameter $D_2$ (measured between the inner most points of two diametrically opposed outer fingers 30, see FIG. 3) would be exemplary.

The spacing of outer fingers 30 relative to one another may be varied without departing from the scope of the present disclosure. In embodiments where the outer fingers 30 are fabricated from a rigid material that will not bend (at least not to any significant degree), it is contemplated that the outer fingers 30 should be spaced apart by a distance $D_3$ of at least 8.5 inches relative to each adjacent outer finger 30 to permit entry of a regulation number 5 soccer ball (which is typically about 27 inches to about 28 inches in circumference, and about 8.5 inches to about 9 inches in diameter). In embodiments where the outer fingers 30 are fabricated from a flexible material (e.g., rubber, silicone, etc.), it is contemplated that smaller intervals of separation may be employed because the outer fingers 30 can bend around the soccer ball. In a preferred embodiment, the outer fingers 30 may be separated by a distance $D_3$ of about 6 inches.

The inner fingers 32 are fingers that extend through the capture space 34. Inclusion of inner fingers 32 is not necessary for any particular embodiment of the goal 100, but it is contemplated that the inclusion of inner fingers 32 may be preferred since they can help dampen/slow the velocity of incoming balls. Further, inner fingers 32 may also help retain/catch smaller soccer balls. In the embodiment shown, the goal 100 includes four inner fingers 32 arranged approximately equidistant from one another, and at a distance $D_4$ of approximately 4.5 inches from the center point of the suspension platform 20 (i.e., radial distance). Of course, like with the outer fingers 30, it is contemplated that other arrangements of inner fingers 32, which may include either more or less inner fingers 32, may also be employed without departing from the scope of the present disclosure.

Referring to FIG. 2, given that foot golf is typically played with a regulation number 5 soccer ball, which is about 8.5 inches to about 9 inches in diameter, the suspension platform 20 should be raised at least 8.5 inches from the ground (thereby ensuring that a regulation number 5 soccer ball can fit underneath the suspension platform). The fingers 30, 32, in turn, may be fabricated in various lengths depending on the elevation of the suspension platform 20. For example, if the suspension platform 20 is designed to be raised at a height $H_1$ of 13 inches from the ground, an appropriate length $L_1$ for the fingers 30, 32 may be about 9 inches. Further, while the outer fingers 30 and inner fingers 32 are shown as being generally equal in length, other embodiments of the goal may include fingers 30, 32 of varying lengths.

The first embodiment 100 notwithstanding, other embodiments of the goal may vary in terms of the height $H_1$ of the suspension platform 20, the length $L_1$ of the fingers 30, 32 and the separation $D_3$ of the outer fingers 30 (relative to one another) to accommodate soccer balls of different sizes, different types of balls, or otherwise as desired without departing from the scope of the present disclosure.

Figure 4:
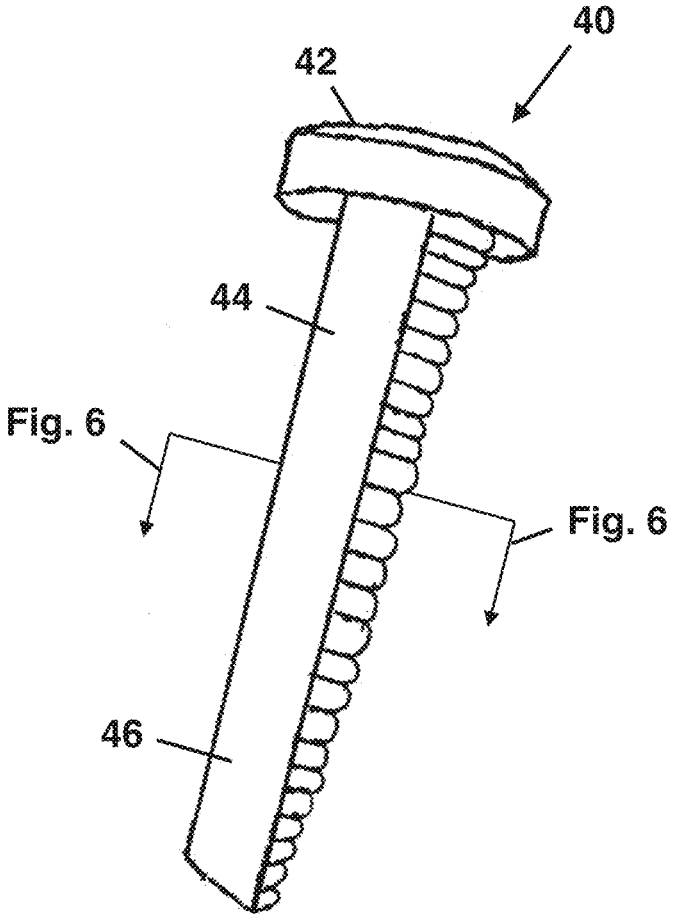
FIG. 4 is a perspective view of an embodiment of a finger.
Figure 5:
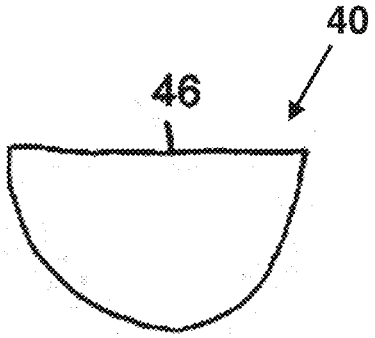
FIG. 5 is a cross-sectional view of the finger of FIG. 4.
Figure 6:
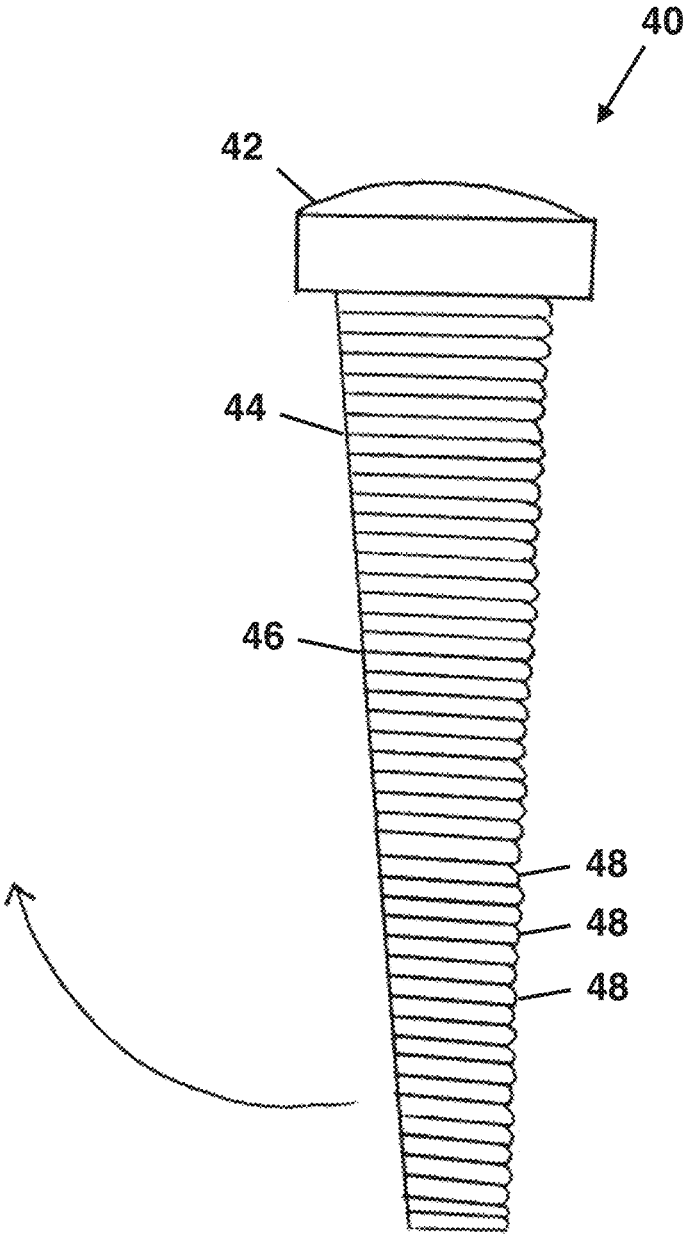
FIG. 6 is a side view of the finger of FIG. 4.

Referring now to FIGS. 4-6, the present disclosure provides an example of an exemplary embodiment of a finger 40 that may be representative of the outer fingers 30 and inner fingers 32. This finger 40 includes a head 42 and a shaft 44. The shaft 44 may be generally rounded (FIG. 5) and may define a downwards taper 46 on one side that extends along the length of the finger 40 (FIG. 6). This taper 46 may facilitate the bending of the shaft 44 towards the side of the taper 46. Thus, when the tapered side is positioned inwards (i.e., facing the capture space 34), the shaft 44 may facilitate balls entering the capture space 34 and resist balls leaving it. Other finger shapes that may be utilized can include, for example, cylindrical, polygonal, or irregular shaped fingers.

In preferred embodiments, the finger 40 may be provided with a series of ridges 48 extending along the length of the shaft 44. These ridges 48 may improve the ability of the finger 40 to stop the movement of the ball by improving grip against a ball. As shown, these ridges 48 may be generally linear in shape and horizontally oriented parallel to one another.

Figure 7:
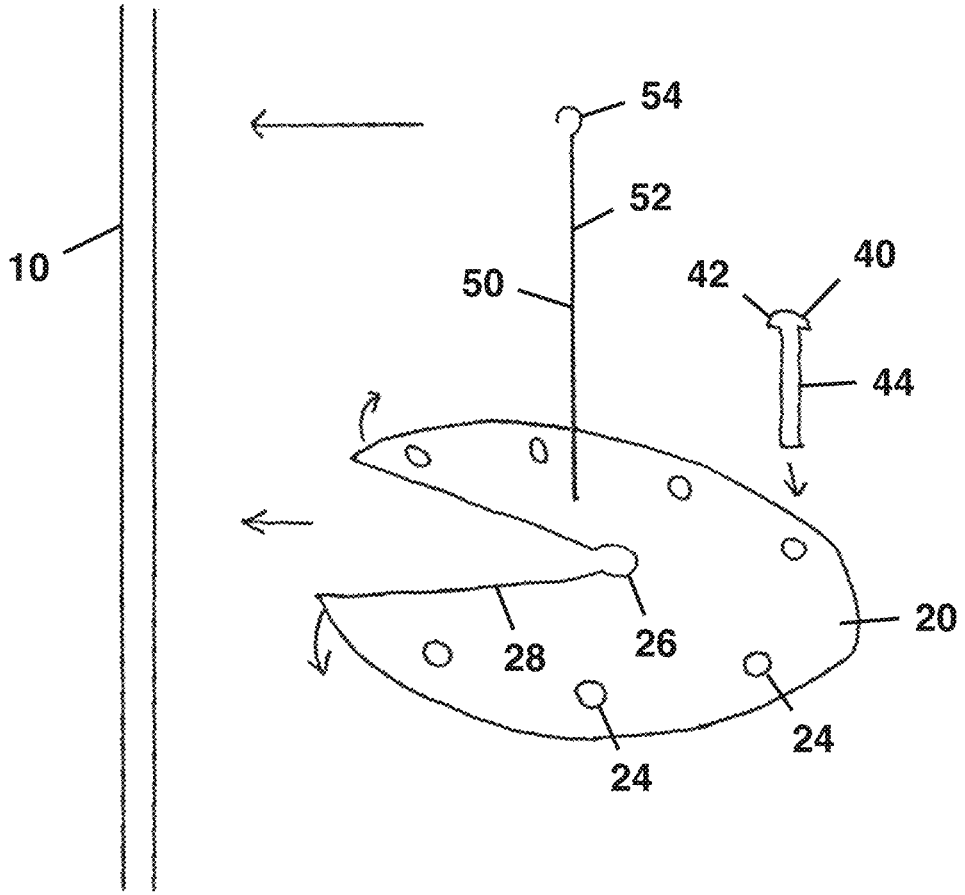
FIG. 7 is a schematic illustration of the first embodiment of the goal being installed on a liner structure.

Referring to FIG. 7, the suspension platform 20 defines a plurality of openings 24 through which the fingers—both the outer fingers 30 and the inner fingers 32—may be inserted through. More specifically, the finger 40 described above may be inserted into one of these openings 24 until the head 42 rests against the upper surface of the suspension platform 20 and the shaft 44 hangs underneath (FIG. 2). These openings 24 should have a width that is generally greater than the shaft 44 but smaller than the head 42. It is contemplated that this configuration may provide for the easy transport, set-up, and removal of the goal 100 as the fingers 30, 32 may be removed from the openings 24 by simply lifting the fingers 30, 32 up out of the openings 24, and then reinserted as needed.

Those skilled in the art will appreciate that the finger-and-opening configuration described above is just one non-limiting embodiment, and that other configurations are certainly possible. Other configurations can include, for example, integrally forming the fingers 30, 32 with the suspension platform 20, fixedly connecting the fingers 30, 32 to the suspension platform 20 (e.g., by way of adhesives, mechanical fasteners, etc.), and/or by some other means of detachable attachment (e.g., magnets, hooks, etc.).

The goal of the first embodiment 100 is configured to hang from a structure 10 and includes one or more attachment members 50 that enable it to do so. Here, any suitable attachment means may be utilized. For example, as shown in FIG. 1, the attachment members 50 may include chains 52 (i.e., a type of linkage) that are connected to the suspension platform 20 on one end and connected to a hook 54 (i.e., a type of connecting means) on the other end. This type of attachment member 50 provides for quick and easy attachment and detachment from a wide variety of structures. Other types of attachment members may utilize, for example, different types of linkages (e.g., rope, string, cables, cords, etc.) and/or different means for connecting (e.g. mechanical fasteners, welds, adhesives, zip ties, etc.).

The goal of the first embedment 100 can be attached to vertically oriented linear structures 10, such as poles and posts. As shown, the suspension platform 20 defines a center opening 26 and includes a slit 28 extending from the center opening 26 to the outer edge of the suspension platform 20 (FIG. 2). The slit 28 enables the suspension platform 20 to be bent in opposing directions (FIG. 4) which opens a pathway for the linear structure 10 to be inserted through the slit 28 and received within the center opening 26. The size and shape of the center opening 26 need not be limiting features and may be varied as needed to accommodate different vertical structures 10 of varying physical dimensions. In preferred embodiments, the center opening 26 may be sized and shaped such that a loose fit is provided between the suspension platform 20 and the vertical structure 10 (FIG. 1). A loose fit enables the suspension platform 20 (and by extension, the overall goal 100) to rotate about the vertical structure 10 which, in effect, enables the fingers 30, 32 to rotationally deflect impacts from balls. Doing so dampens the ball's movement and thereby improves the ability of the goal 100 to capture the ball.

Optionally, the goal 100 may be provided with a closing means 56 configured to keep the slit 28 closed. For example, the goal 100 may be provided with a bracket that permanently closes the slit (FIG. 10). Alternatively, releasable closing means 56, such as fasteners and latches, may also be utilized.

As shown in FIG. 1, it is contemplated that goal of the first embodiment 100 may be attached to disc golf goal 8. Disc golf goals 8 typically include a central pole/post 10 and a basket for catching frisbee discs. As shown, the goal of the first embodiment 100 may be received around the central pole/post 10 and may hang beneath the basket by way of the attachment members 50. The combination of the two may effectively amount to a dual-purpose disc golf and foot golf goal that can capture both discs and balls.

Of course, it is contemplated that a dual-purpose disc golf and foot golf goal can be fabricated outright, with the goal of the first embodiment 100 integrated into/with the design/fabrication of the disc golf goal. Such a dual-purpose goal may feature a permanent attachment of the foot golf goal to disc golf goal (e.g., direct chain linkage), instead of using hooks 54.

Figure 11:
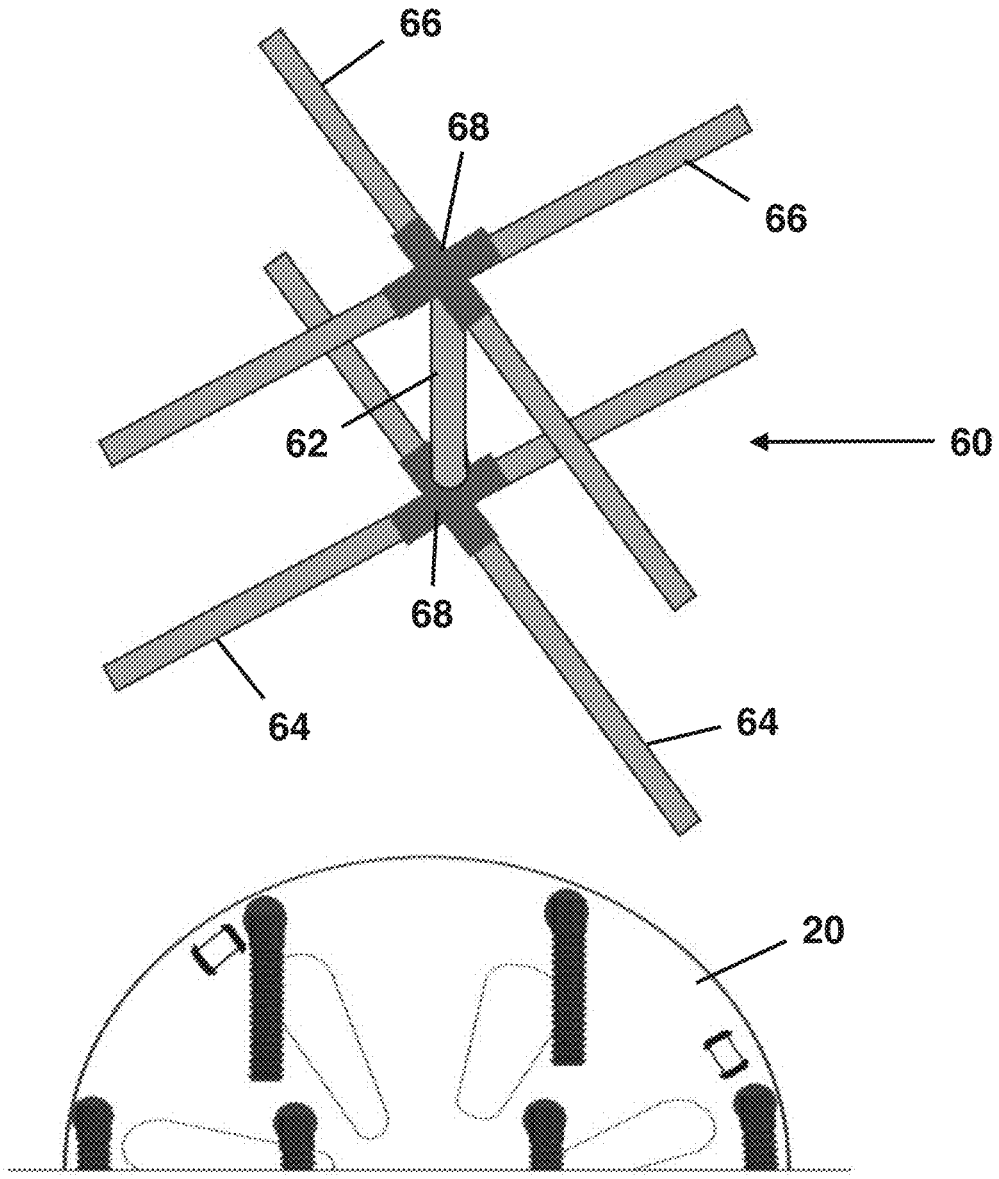
FIG. 11 is a top perspective view of the stand of the goal of FIG. 8.
Figure 12:
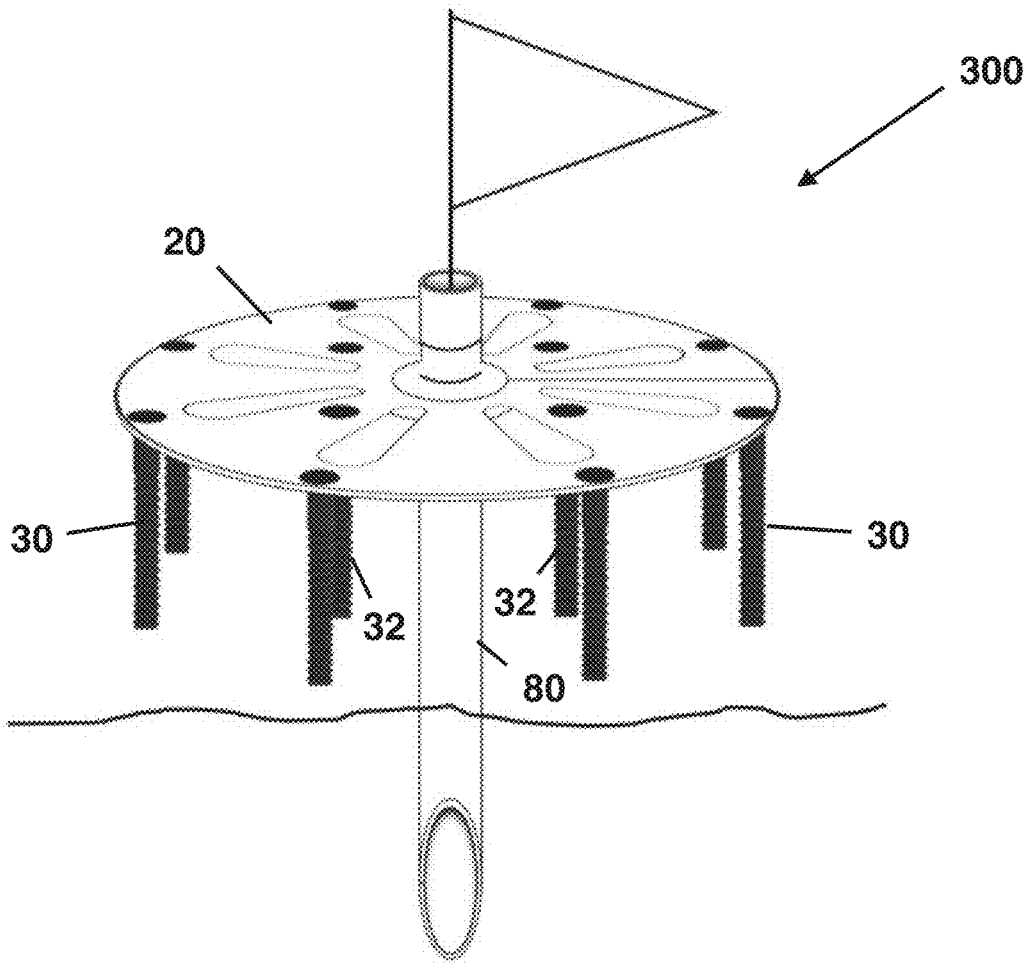
FIG. 12 is a side perspective view of a third embodiment of the goal for foot golf.
Figure 13:
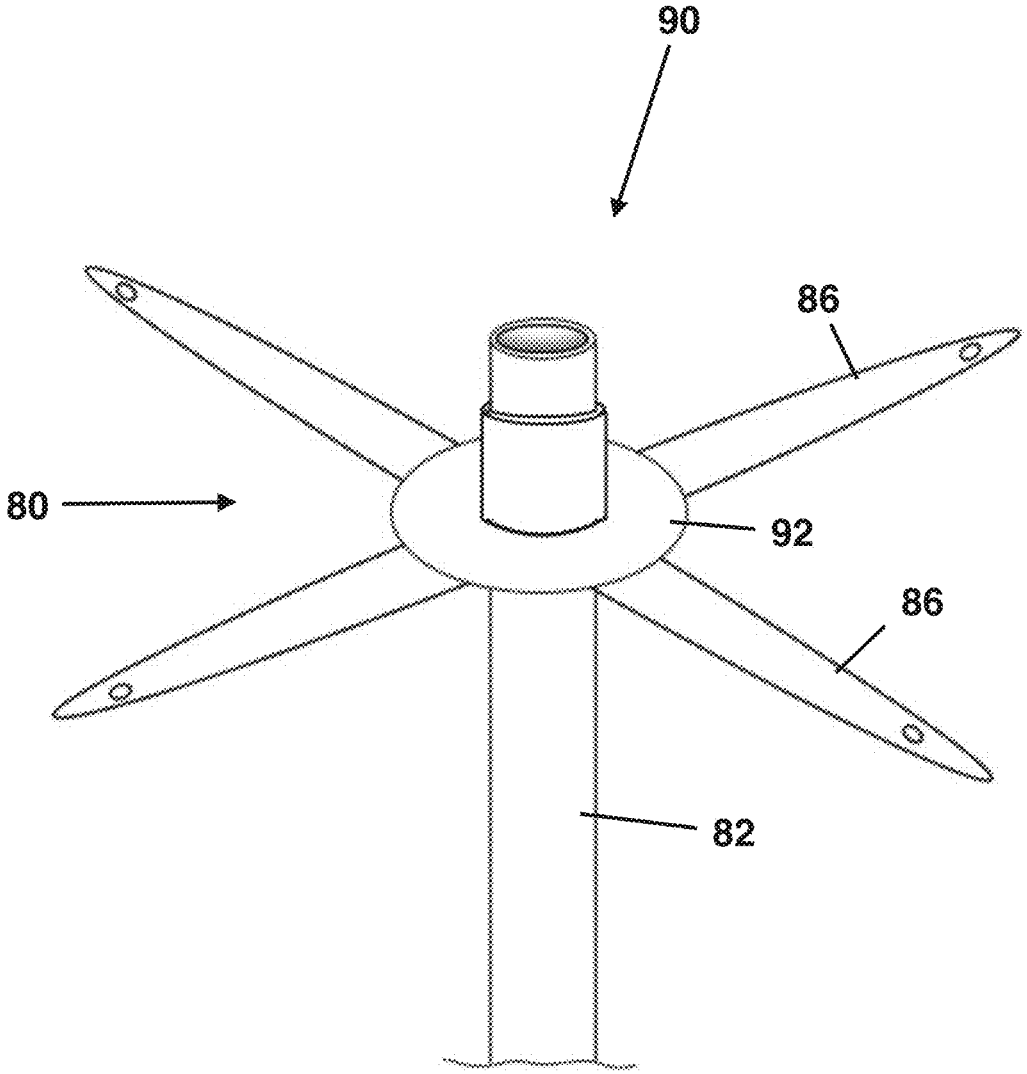
FIG. 13 is a top perspective view of the stand of the goal of FIG. 12.
Figure 14:
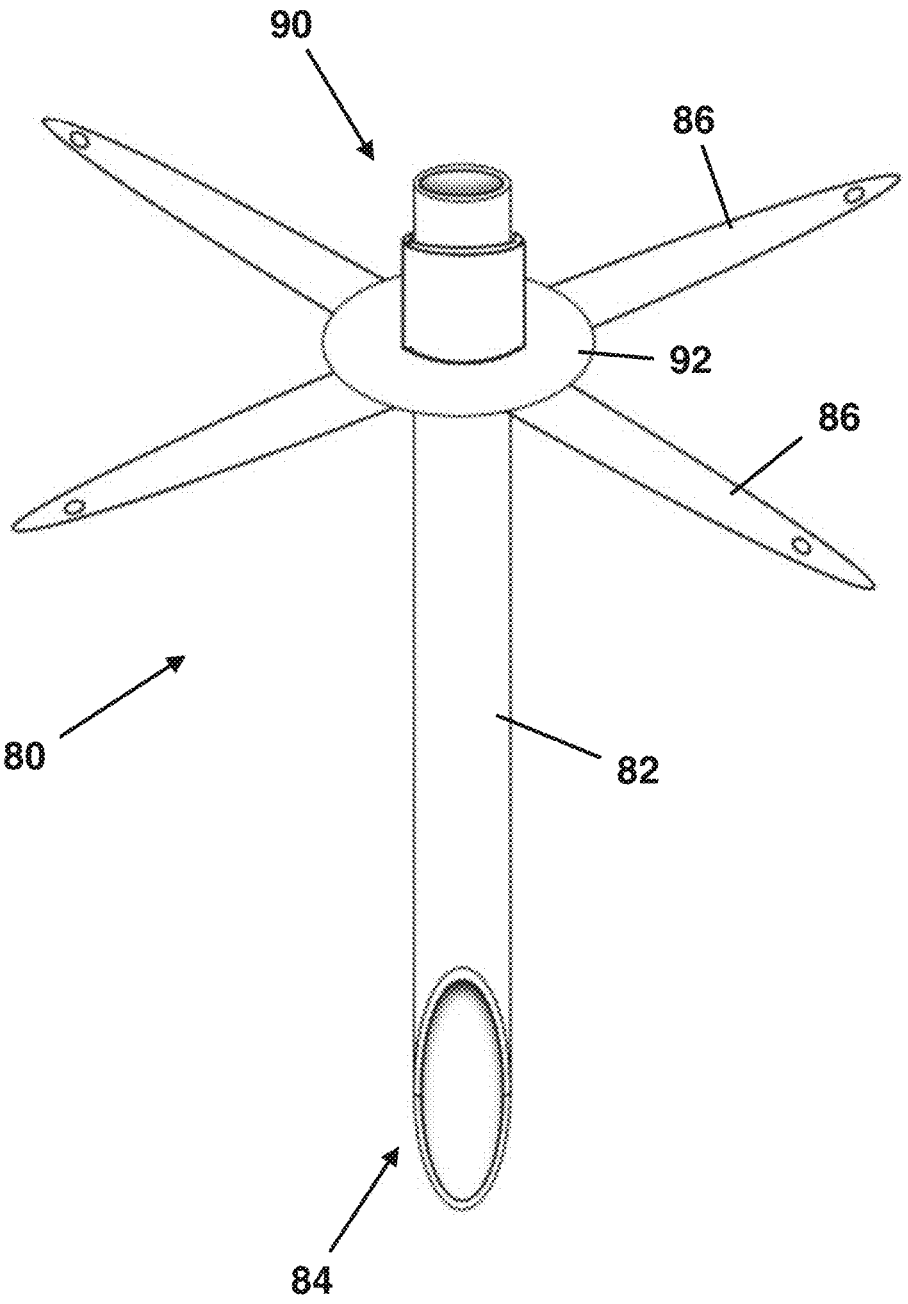
FIG. 14 is a bottom perspective view of the stand of the goal of FIG. 12.

Referring to FIGS. 8-14, the present disclosure provides two other embodiments of the goal for foot golf—a second embodiment 200 (FIGS. 8-11) and a third embodiment 300 (FIGS. 12-14). The second and third embodiments 200, 300 differ from the first embodiment 100 in that they are configured to be supported from beneath rather than hang from a structure 10. Instead of having attachment members 50, they have stands 60, 80.

Figure 8:
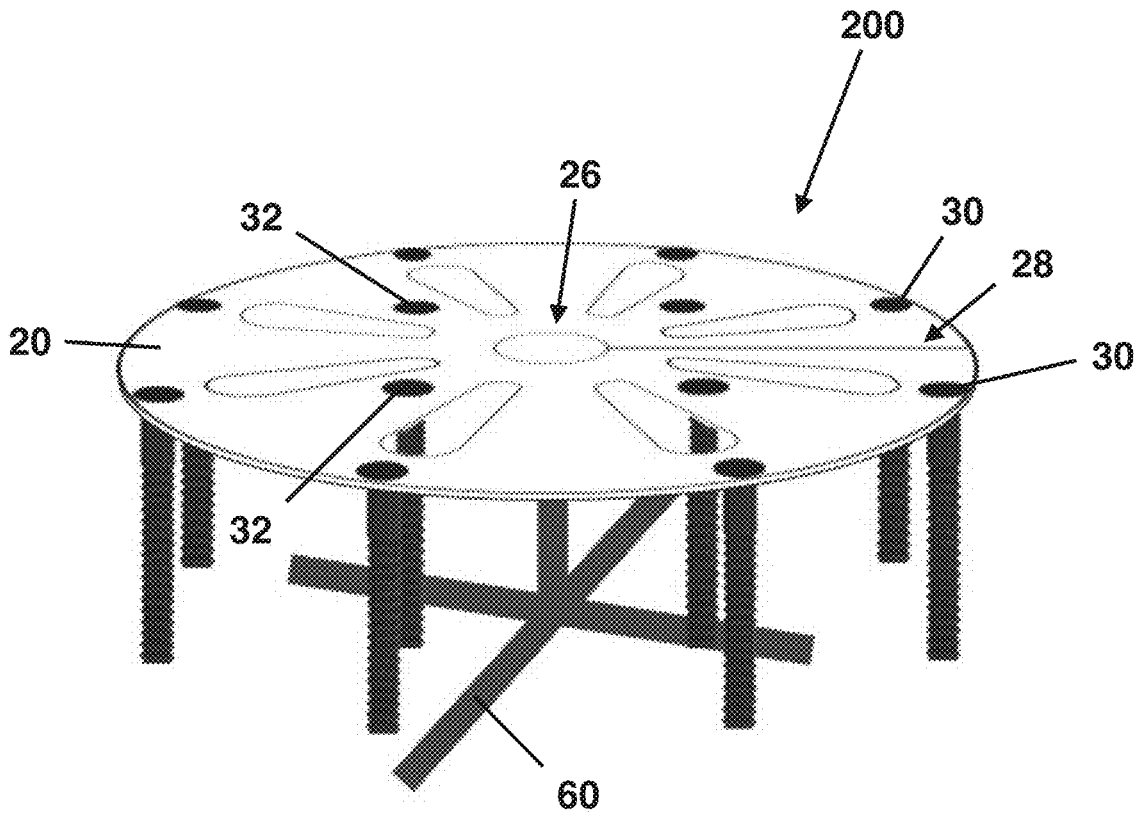
FIG. 8 is a perspective view of a second embodiment of the goal for foot golf.

Referring to FIG. 8, the second embodiment 200 of the foot golf goal may include a suspension platform 20, a plurality of fingers 30, 32 and configurations for each that can generally be the same as the first embodiment 100. That is to say, the suspension platform 20 includes a body that is generally circular and planar; the fingers 30, 32 may be the same as the finger 40 shown in FIGS. 4-6; and the suspension platform 20 may define a plurality of openings 24 through which the fingers 30, 32 may be inserted. Here, a slit 28 and a central opening 26 may, but need not, be included. Variations in the suspension platform 20 and in the fingers 30, 32 previously described in this disclosure may be incorporated in this embodiment as well without departing from the scope of the present disclosure.

Figure 9:
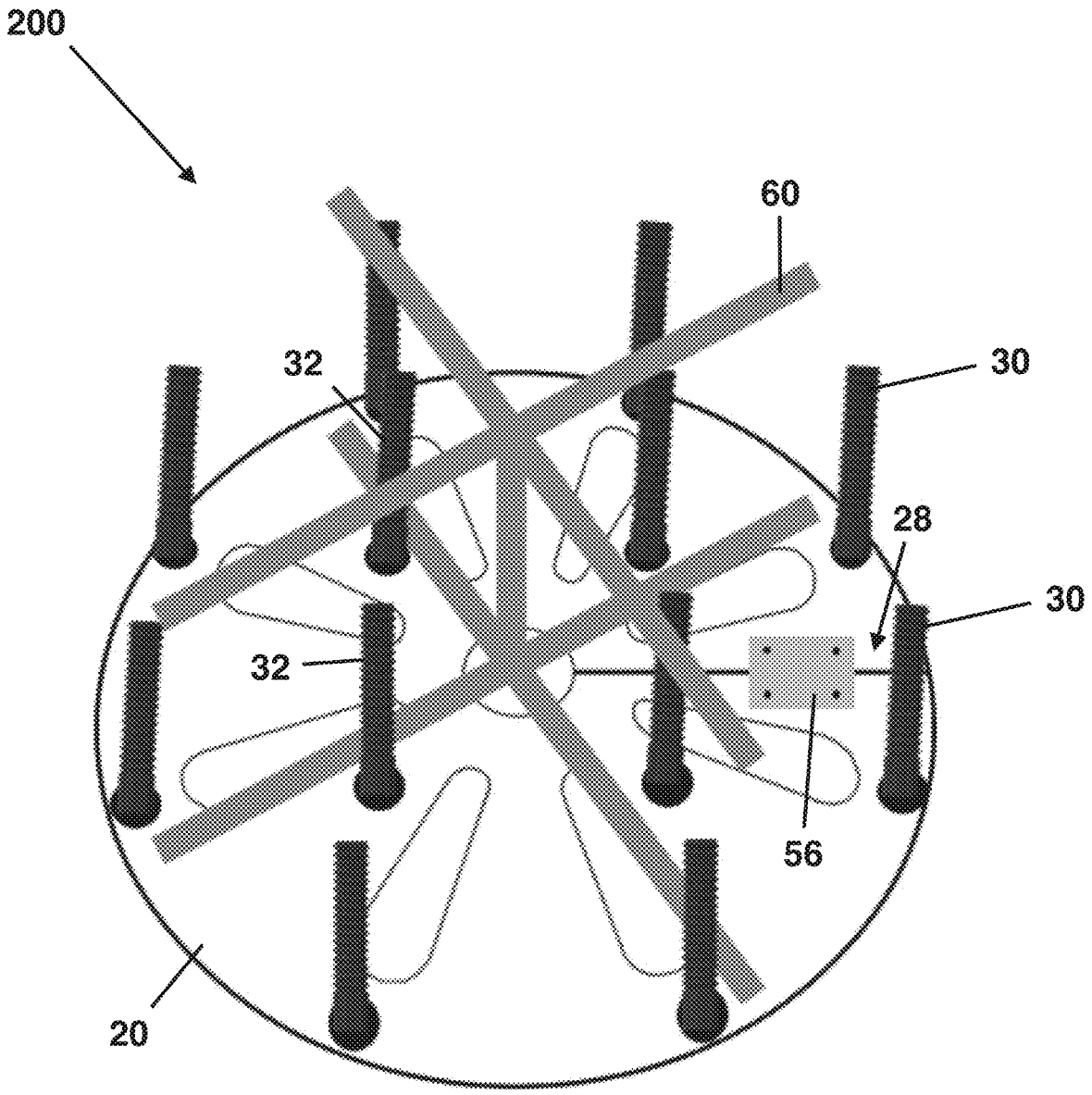
FIG. 9 is a bottom perspective view of the goal of FIG. 8.

Referring to FIGS. 9 and 11, the goal of the second embodiment 200 includes a stand 60 having a central column 62, a base 64 connected to the bottom of the central column 62, and at least one support members 66 extending outwards horizontally from the top of the central column 62. The base 64 can include any suitable means for orienting the central column 62 vertically upright and the support members 66 can include any suitable means for supporting the suspension platform 20 from below. For example, in the embodiment shown the base 64 and the support members 66 each include four perpendicular tubes extending from the bottom and top of the central column 62, respectively. These tubes may be connected to the central column 62 via tube connectors 68. Ideally, the tube connectors 68 may receive the tubes in a friction fit so that the stand 60 can be easily disassembled and reassembled as needed.

The overall height of the stand 60 of the second embodiment 200, measured from the bottom of the base 64 to the top of the support members 66, may vary without departing from the scope of the present disclosure. Preferably, this height may be about 9 inches to about 13 inches, or more preferably about 12 inches.

Referring to FIGS. 9 and 10, the goal of the second embodiment 200 may further include a plurality of tube fasteners 70 (e.g., U-clip fasteners) mounted on the bottom surface of the suspension platform 20 that align with the tubes of the support members 66. These tube fasteners 70 may be configured to receive the tubes of the support members 66 in a press fit or friction fit, thereby securing (i.e., releasably securing) the suspension platform 20 on top of the stand 60. Of course, other securing means for securing the suspension platform 20 can also be utilized such as, for example, adhesives, fasteners, combinations thereof, and/or the like.

Referring to FIG. 12, the third embodiment 300 of the foot golf goal may include a suspension platform 20, a plurality of fingers 30, 32 and configurations for each that can generally be the same as the first embodiment 100. That is to say, the suspension platform 20 includes a body that is generally circular and planar; the fingers 30, 32 may be the same as the finger 40 shown in FIGS. 4-6; and the suspension platform 20 may define a plurality of openings 24 through which the fingers 30, 32 may be inserted. A central opening 26 may also be defined in the suspension platform. Variations in the suspension platform 20 and in the fingers 30, 32 previously described in this disclosure may be incorporated in this embodiment as well without departing from the scope of the present disclosure.

Referring to FIGS. 13 and 14, the stand 80 of the third embodiment 300 is similar to the stand 60 of the second embodiment 200 in that it also includes a central column 82 and support members 86 extending outwards horizontally from the top of the central column 82. Here, the support members 86 include four perpendicularly arranged L-brackets rather than tubes. However, this is not meant to be limiting as it is contemplated that tubes and other types of support members can be utilized as well. Further, rather than having a base 64, the stand 80 of the third embodiment 300 instead features a pointed bottom end 84 that enables the central column 82 to be inserted into the ground (i.e., by piercing the ground). By doing so, the ground can hold the central column 82 vertically upright.

To secure the suspension platform 20 onto stand 80, the stand 80 may be provided with a threaded nut-and-bolt arrangement 90 extending above the support members 86. The nut-and-bolt arrangement 90 may be co-axial with the central column 82. In use, the bolt may be inserted through the central opening 26 of the suspension platform 20 and the nut may be threaded onto the bolt, thereby clamping the suspension platform between the nut and the support members 86. To improve securement, the nut may also be provided with a lower flange 92 that increases clamp surface area.

The overall height of the stand 80 of the third embodiment 300, measured from the bottommost point of the pointed bottom end 84 to the top of the support members 86, may vary without departing from the scope of the present disclosure. Preferably, this height may be about 20 inches to about 24 inches, or more preferably about 22 inches.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A goal for foot golf comprising:

a suspension platform configured for suspension above the ground, the suspension platform comprising a planar body that defines an upper surface, bottom surface, a central opening, an outer edge, and a slit, wherein the slit extends from the upper surface to the bottom surface and from the central opening to the outer edge, and wherein the planar body further comprises a plurality of openings in a circular arrangement;

a plurality of attachment members connected to the body of the suspension platform that enable attachment of the suspension platform to a structure;

a plurality of outer fingers, each outer finger comprising a head and a shaft, wherein the head of each outer finger comprises a width, the shaft of each outer finger comprises a width, and, for each outer finger, the width of the head is greater than the width of the shaft; and wherein, for each outer finger, the shaft may be removably inserted into an opening of the suspension platform from above so that the head of the outer finger rests upon the upper surface of the suspension platform body while the shaft extends below it.

2. The goal of claim 1, wherein the body of the suspension platform comprises at least one cut-out extending through the body that permits precipitation to pass through the suspension platform.

3. The goal of claim 1, wherein the plurality of outer fingers comprises a flexible material that enables the outer fingers to bend upon contact with a ball.

4. The goal of claim 3, wherein the circular arrangement of the outer fingers comprises an equidistant spacing of about 6 inches between adjacent outer fingers.

5. The goal of claim 1, wherein the goal further comprises a plurality of inner fingers extending downwards from the suspension platform, and wherein the inner fingers are disposed at points along the suspension platform that are within the circular arrangement of outer fingers.

6. The goal of claim 1, wherein the plurality of outer fingers comprises an outer finger that is about nine inches in length.

7. The goal of claim 1, wherein an outer finger of the plurality of outer fingers comprises a shaft that defines a top-to-bottom taper on one side of the shaft.

8. The goal of claim 1, wherein an outer finger of the plurality of outer fingers comprises a shaft that comprises a plurality of ridges.

9. A goal for foot golf comprising:

a suspension platform configured to hang from a structure, the suspension platform comprising a planar body that defines an upper surface, a bottom surface, a central opening, an outer edge, and a slit, wherein the slit extends from the upper surface to the bottom surface and from the central opening to the outer edge;

a plurality of outer fingers extending downwards from the suspension platform, wherein the plurality of outer fingers is disposed about the suspension platform in a circular arrangement; and a plurality of attachment members connected to the body of the suspension platform that enable attachment of the suspension platform to a structure.

10. The goal of claim 9, wherein the plurality of attachment members comprises an attachment member that comprises a linkage and a connecting means, and wherein the linkage is connected at one end to the body of the suspension platform and connected at the other end to the connecting means.

11. The goal of claim 9 further comprising a closing means attached to the suspension platform that is configured to keep the slit closed.

* * * * *